US011940192B2

(12) United States Patent
Tsukiyama et al.

(10) Patent No.: US 11,940,192 B2
(45) Date of Patent: Mar. 26, 2024

(54) AIR CONDITIONING DEVICE

(71) Applicant: Mitsubishi Electric Corporation, Tokyo (JP)

(72) Inventors: Ryo Tsukiyama, Tokyo (JP); Satoru Yanachi, Tokyo (JP); So Nomoto, Tokyo (JP); Takuya Matsuda, Tokyo (JP); Naoki Kato, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 466 days.

(21) Appl. No.: 17/281,008

(22) PCT Filed: Dec. 18, 2018

(86) PCT No.: PCT/JP2018/046542
§ 371 (c)(1),
(2) Date: Mar. 29, 2021

(87) PCT Pub. No.: WO2020/129153
PCT Pub. Date: Jun. 25, 2020

(65) Prior Publication Data

US 2021/0341193 A1 Nov. 4, 2021

(51) Int. Cl.
*F25B 47/02* (2006.01)
*F25B 7/00* (2006.01)
(Continued)

(52) U.S. Cl.
CPC ..... *F25B 47/02* (2013.01); *F25B 7/00* (2013.01); *F25B 41/20* (2021.01); *F25B 41/31* (2021.01);
(Continued)

(58) Field of Classification Search
CPC ..... F25B 47/02; F25B 41/31; F25B 41/20; F25B 7/00; F25B 2500/09; F25B 2600/024; F25B 2600/13; F25B 2600/2515
See application file for complete search history.

(56) References Cited

U.S. PATENT DOCUMENTS

2015/0253049 A1* 9/2015 Tsai ..... F24H 15/38 62/82
2017/0027409 A1* 2/2017 Anim-Mensah .... A47L 15/4285

FOREIGN PATENT DOCUMENTS

CN 104566835 A 4/2015
EP 2309199 A1 4/2011
(Continued)

OTHER PUBLICATIONS

1 Extended European Search Report dated Nov. 26, 2021 issued in corresponding EP application No. 18944079.5.
(Continued)

*Primary Examiner* — Henry T Crenshaw
(74) *Attorney, Agent, or Firm* — POSZ LAW GROUP, PLC

(57) ABSTRACT

An air conditioning device has: a refrigerant circuit that includes a compressor, a switching valve, a cascade heat exchanger, an expansion valve and an outdoor heat exchanger connected to one another by a first pipe through which a refrigerant flows, and that performs a defrosting operation in which the refrigerant discharged from the compressor is introduced into the outdoor heat exchanger; a heat-transfer medium circuit that includes a pump, the cascade heat exchanger, and the indoor heat exchanger connected to one another by a second pipe through which a heat-transfer medium flows; and a control device that controls the compressor and the pump. When an amount of heat storage of the heat-transfer medium is less than a threshold,
(Continued)

the control device reduces the heating capability of the indoor heat exchanger when the air conditioning device transitions from a heating operation to the defrosting operation.

8 Claims, 9 Drawing Sheets

(51) Int. Cl.
*F25B 41/20* (2021.01)
*F25B 41/31* (2021.01)

(52) U.S. Cl.
CPC ..... *F25B 2500/09* (2013.01); *F25B 2600/024* (2013.01); *F25B 2600/13* (2013.01); *F25B 2600/2515* (2013.01)

(56) References Cited

FOREIGN PATENT DOCUMENTS

| | | | | |
|---|---|---|---|---|
| JP | H08-28932 | A | | 2/1996 |
| JP | 2010261665 | A | * | 11/2010 |
| JP | 2014228261 | A | | 12/2014 |

OTHER PUBLICATIONS

Chinese Office Action dated May 6, 2022 issued in corresponding Chinese Patent Application No. 201880099733.1 (and English Translation).
International Search Report, dated Feb. 5, 2019, issued in corresponding International Application No. PCT/JP2018/046542.
Office Action dated Jul. 5, 2023 issued in corresponding EU patent application No. 18 944 079.5.

* cited by examiner

→ FLOW OF REFRIGERANT DURING HEATING OPERATION AND PREHEAT OPERATION

⇢ FLOW OF REFRIGERANT DURING DEFROSTING OPERATION

➡ FLOW OF HEAT-TRANSFER MEDIUM

| HEATING CAPABILITY |  | | |
|---|---|---|---|
| WATER FLOW RATE | INCREASE | DECREASE | ··· |
| DEGREES OF OPENING OF FLOW REGULATING VALVES | INCREASE | DECREASE | ··· |

AIR CONDITIONING DEVICE

CROSS REFERENCE TO RELATED APPLICATION

This application is a U.S. National Stage Application of International Application No. PCT/JP2018/046542, filed on Dec. 18, 2018, the contents of which are incorporated herein by reference.

TECHNICAL FIELD

The present disclosure relates to an air conditioning device.

BACKGROUND ART

Conventionally, an apparatus is known which stores heat in a thermal storage vessel prior to a defrosting operation and uses the heat stored in the thermal storage vessel during the defrosting operation so that the heating capability does not degrade during the defrosting operation.

For example, in the winter nighttime operation, the regenerative air-conditioner disclosed in Japanese Patent Laying-Open No. H8-28932 (PTL 1) performs a heat storage operation for turning water, which is a thermal storage material, into warm water via a primary heat exchange unit within a thermal storage vessel by controlling a second expansion valve in a primary refrigerant circuit in which a compressor, a first four-way valve, an outdoor heat exchanger, a second expansion valve, and the primary heat exchange unit within the thermal storage vessel are in communication.

In the heating operation when the outdoor air temperature is low, the above regenerative air-conditioner continues the heating operation by forming a refrigeration cycle in which: the primary heat exchange unit within the thermal storage vessel is used as an evaporator and the outdoor heat exchanger is used as a condenser in the primary refrigerant circuit; and the secondary heat exchanger within the thermal storage vessel and the secondary heat exchanger included in a refrigerant-to-refrigerant heat exchanger are connected in series by opening the bypass valve and fully closing a flow regulating valve for the thermal storage vessel in the secondary heat-transfer medium circuit.

CITATION LIST

Patent Literature

PTL 1: Japanese Patent Laying-Open No. H8-28932

SUMMARY OF INVENTION

Technical Problem

The regenerative air-conditioner disclosed in PTL 1 requires a thermal storage vessel as a heat source for maintaining the heating even in the defrosting operation. However, in the environment where a thermal storage vessel cannot be installed, heat cannot be stored prior to the defrosting operation. Although, for example, warm water within the pipes and heat exchangers can be considered as a heat source, without having to provide a thermal storage vessel, such warm water is small in quantity and thus unable to maintain the heating during the defrost time.

Therefore, an object of the present disclosure is to provide an air conditioning device which allows the heating to be maintained even during the defrosting operation, without having to provide a thermal storage vessel.

Solution to Problem

An air conditioning device according to the present disclosure includes a refrigerant circuit, a heat-transfer medium circuit, and a control device. The refrigerant circuit is formed of a compressor, a first heat exchanger, an expansion valve, and a second heat exchanger connected to one another by a first pipe to allow a refrigerant to flow through the refrigerant circuit, and is capable of a defrosting operation in which the refrigerant discharged from the compressor is introduced into the second heat exchanger. The heat-transfer medium circuit is formed of a pump, the first heat exchanger, and a third heat exchanger connected to one another by a second pipe and allows a heat-transfer medium to flow through the heat-transfer medium circuit. The control device controls the compressor and the pump. The control device performs the defrosting operation while maintaining the heating, with a heating capability of the third heat exchanger during the defrosting operation set to a capability that is determined based on an amount of heat storage of the heat-transfer medium within the heat-transfer medium circuit. When the amount of heat storage of the heat-transfer medium is less than a threshold, the control device reduces the heating capability of the third heat exchanger when the air conditioning device transitions from a heating operation to the defrosting operation.

Advantageous Effects of Invention

According to the present disclosure, the heating capability is set based on the amount of heat storage of the heat-transfer medium within the heat-transfer medium circuit, and the heating during the defrosting operation is maintained with the set heating capability. Accordingly, a cool air can be prevented from being discharged by the heat-transfer medium being cooled during the defrosting operation.

DESCRIPTION OF EMBODIMENTS

Hereinafter, an embodiment according to the present disclosure will be described, with reference to the accompanying drawings. In the following, a number of embodiments are described. The configurations described in respective embodiments are intended to be combined as appropriate in the application as initially filed. Note that the same reference signs are used to refer to the same or like parts, and the description thereof will not be repeated.

Figure 1:
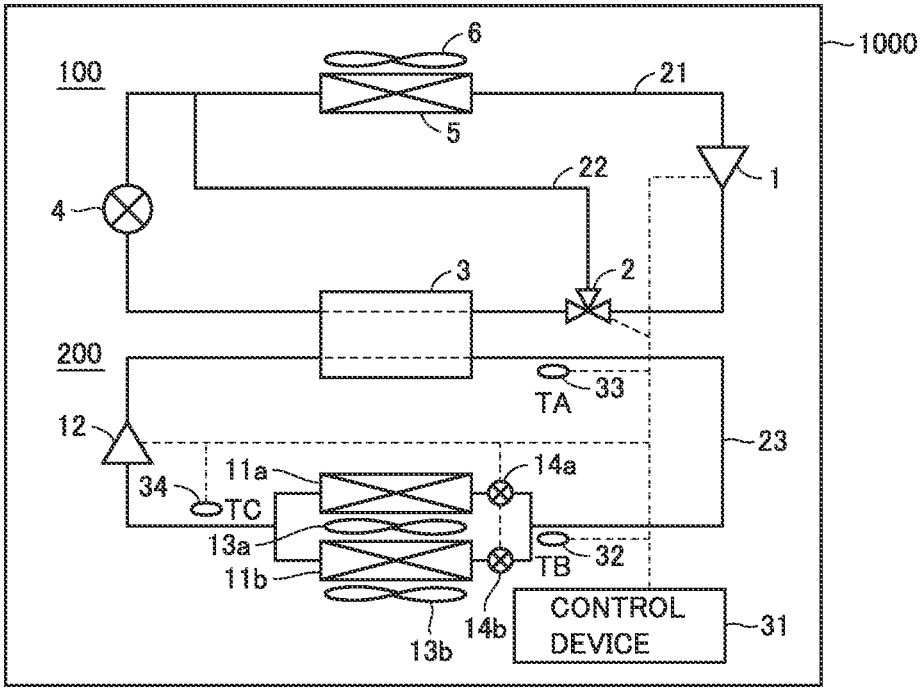
FIG. 1 is a diagram showing a configuration of an air conditioning device 1000 according to the present embodiment.

FIG. 1 is a diagram showing a configuration of an air conditioning device 1000 according to the present embodiment. Referring to FIG. 1, air conditioning device 1000 includes an outdoor unit and an indoor unit.

The outdoor unit includes a refrigerant circuit 100, and a blower 6 for blowing to an outdoor heat exchanger 5.

The indoor unit includes a heat-transfer medium circuit 200, blowers 13*a*, 13*b* for blowing to indoor heat exchangers 11*a*, 11*b*, respectively, and temperature sensors 32, 33, 34. Heat-transfer medium circuit 200 is formed of indoor heat exchangers 11*a*, 11*b* connected in parallel, flow regulating valves 14*a*, 14*b*, a pump 12, and a cascade heat exchanger 3, which are connected to one another by a second pipe 23.

In the following, indoor heat exchangers 11*a*, 11*b* may be collectively referred to as an indoor heat exchanger 11, blowers 13*a*, 13*b* may be collectively referred to as a blower 13, and flow regulating valves 14*a*, 14*b* may be collectively referred to as a flow regulating valve 14. The indoor unit may include indoor heat exchangers 11*a*, 11*b* as two units separately disposed. Cascade heat exchanger 3 and pump 12 may be disposed in a relay unit separated from the indoor unit. Note that a control device 31 may be disposed in either the outdoor unit or the indoor unit, or may be disposed anywhere other than in the outdoor unit and the indoor unit.

Primary refrigerant circuit 100 has a compressor 1, a switching valve 2, cascade heat exchanger 3, an expansion valve 4, and outdoor heat exchanger 5, which are connected to one another by a first pipe 21. Refrigerant circuit 100 further has a bypass pipe 22. Bypass pipe 22 connects switching valve 2 and a branch between expansion valve 4 and outdoor heat exchanger 5 along first pipe 21. A refrigerant flows through refrigerant circuit 100. Note that, the "refrigerant," as used herein, refers to, a refrigerant, such as fluorocarbon, which is used in a refrigeration cycle apparatus, and compressed in a gaseous state by a compressor, condensed from a gaseous state to a liquid state by a condenser, and evaporated from a liquid state to a gaseous state by an evaporator.

Air conditioning device 1000 switches the operation between a heating operation, a defrosting operation, and a preheat operation which is performed after the heating operation and prior to the defrosting operation. The preheat operation is performed prior to the defrosting operation. A heat used in the defrosting operation is stored during the preheat operation.

Secondary heat-transfer medium circuit 200 has pump 12, cascade heat exchanger 3, and indoor heat exchanger 11, which are connected to one another by a second pipe 23. A heat-transfer medium flows through heat-transfer medium circuit 200. The "heat-transfer medium," as used herein, refers to a medium Which circulates, primarily, in a liquid state, through secondary heat-transfer medium circuit 200, and is, for example, antifreeze (brine), water, or an antifreeze-water mixture.

Compressor 1 draws in and compresses a low-pressure refrigerant, and discharges it as a high-pressure refrigerant. Compressor 1 is, for example, an inverter compressor.

Switching valve 2 switches flow passages for the refrigerant. In the heating operation and the preheat operation, switching valve 2 connects the discharge side of compressor 1 to the inlet of cascade heat exchanger 3, thereby forming a first flow passage which allows the refrigerant, discharged from compressor 1, to flow to cascade heat exchanger 3. In the defrosting operation, switching valve 2 connects the discharge side of compressor 1 to the inlet of outdoor heat exchanger 5 via bypass pipe 22, thereby forming a second flow passage Which allows the refrigerant, discharged from compressor 1, to flow to outdoor heat exchanger 5. Switching valve 2 switches the flow passages, in accordance with an instruction signal from control device 31.

Cascade heat exchanger 3 causes heat exchange between the refrigerant compressed by compressor 1 and the heat-transfer medium discharged from pump 12. Cascade heat exchanger 3 is, for example, a plate heat exchanger.

Expansion valve 4 decompresses and expands the refrigerant discharged from cascade heat exchanger 3.

In the heating operation and the preheat operation, outdoor heat exchanger 5 causes the refrigerant decompressed by expansion valve 4 to exchange heat with the outdoor air. The air from blower 6 promotes the heat exchange in outdoor heat exchanger 5. Blower 6 includes a fan and a motor for rotating the fan. In the defrosting operation, outdoor heat exchanger 5 causes a high-temperature, high-pressure gas refrigerant, discharged and directly sent from compressor 1, to exchange heat with the outdoor air and the frost formed on, for example, the fins of outdoor heat exchanger 5 to melt the frost.

Pump 12 supplies cascade heat exchanger 3 with the heat-transfer medium discharged from indoor heat exchanger 11.

Indoor heat exchanger 11 causes the heat-transfer medium to exchange heat with the indoor air. The air from blower 13 promotes the heat exchange in indoor heat exchanger 11. Blower 13 includes a fan and a motor for rotating the fan.

Figure 2:
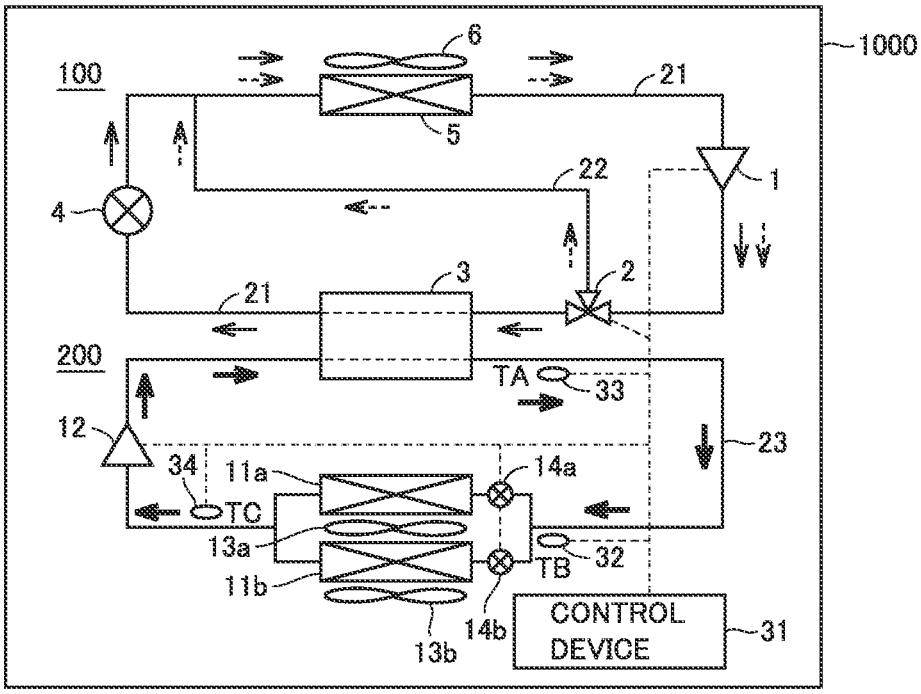
FIG. 2 is a diagram showing flows of a refrigerant and a heat-transfer medium in air conditioning device 1000.

FIG. 2 is a diagram representing flows of the refrigerant and the heat-transfer medium in air conditioning device 1000.

In the refrigerant circuit, the refrigerant flows through different flow passages in the heating operation, the preheat operation, and the defrosting operation.

In the heating operation and the preheat operation, the refrigerant compressed by compressor 1 passes through switching valve 2, cascade heat exchanger 3, expansion valve 4, and outdoor heat exchanger 5, and returns to compressor 1. In the defrosting operation, the refrigerant compressed by compressor 1 passes through switching valve 2, bypass pipe 22, and outdoor heat exchanger 5, and returns to compressor 1.

In the heat-transfer medium circuit, the heat-transfer medium discharged from pump 12 is sent to cascade heat exchanger 3, passes through indoor heat exchanger 11, and returns to pump 12.

Temperature sensor 32 is disposed near the inlet of indoor heat exchanger 11 for heat-transfer medium. Temperature sensor 32 detects a temperature TB of the heat-transfer medium at the inlet of indoor heat exchanger 11.

Temperature sensor 33 is disposed near the outlet of cascade heat exchanger 3 for the heat-transfer medium. Temperature sensor 33 detects a temperature TA of the heat-transfer medium at the secondary outlet of cascade heat exchanger 3.

Temperature sensor 34 is disposed near the outlet of indoor heat exchanger 11 for the heat-transfer medium. Temperature sensor 34 detects a temperature TC of the heat-transfer medium at the outlet of indoor heat exchanger 11.

Control device 31 obtains temperature TB output from temperature sensor 32, temperature TA output from temperature sensor 33, and temperature TC output from temperature sensor 34. Control device 31 controls compressor 1, switching valve 2, expansion valve 4, blower 6, pump 12, blower 13, and flow regulating valve 14.

As compared to the frequency of compressor 1 and the rotational speed of pump 12 in the heating operation, control device 31 increases the frequency of compressor 1 to increase the temperature of the heat-transfer medium and reduces the rotational speed of pump 12 in the preheat operation, to prevent an excess in heating capability. In the preheat operation, control device 31 may increase the frequency of compressor 1, as compared to the frequency of compressor 1 in the heating operation, and then reduce the rotational speed of pump 12 in response to an increase of temperature TB of the heat-transfer medium at the inlet of indoor heat exchanger 11.

In the preheat operation, control device 31 switches the operation of refrigerant circuit 100 to the defrosting operation when temperature TB of the heat-transfer medium at the inlet of indoor heat exchanger 11 reaches a target temperature (threshold temperature).

In the defrosting operation, control device 31 switches refrigerant circuit 100 to the heating operation when defrost is completed after a period of time Tdf has elapsed since the start of the defrosting operation.

Control device 31 sets a target temperature TM for the heat-transfer medium, based on an amount of heat-transfer medium present between the secondary outlet of cascade heat exchanger 3 and the inlet of indoor heat exchanger 11, and an amount of heat that is accumulated in the heat-transfer medium during the preheat operation. Knowing the amount of heat-transfer medium present between the secondary outlet of cascade heat exchanger 3 and the inlet of indoor heat exchanger 11, which is the outbound path for the heat-transfer medium, the amount of heat-transfer medium on the return path can be considered to be the same. The amount of heat accumulated in the heat-transfer medium during the preheat operation can be greater than or equal to an amount of heat that is required to melt an expected maximum amount of frost formed on outdoor heat exchanger 5.

Air conditioning device 1000, shown in FIGS. 1 and 2, prevents a decrease in the room temperature during the defrosting operation by performing, prior to the defrosting operation, the preheat operation in which the water temperature in a water circuit is increased to secure the amount of heat required for the defrosting in order to eliminate a thermal storage tank. At this time, just increasing the water temperature can cause an excess in indoor heating capability, which may increase the room temperature higher than a desired value before the defrosting. In order to prevent this, the frequency of a water-conveying pump is reduced during the preheat operation and the defrosting operation, and the heating is maintained while keeping the heating capability constant.

However, the length of the pipe of the heat-transfer medium circuit depends on a place Where it is installed, which changes the amount of heat-transfer medium sealed within the heat-transfer medium circuit. The constraints arising from a device (or the constraints arising from a physical property of the heat-transfer medium) also place an upper limit on the temperature of the heat-transfer medium. For example, the temperature that the device can resist is an example of the constraints arising from the device. Where the heat-transfer medium is water, the boiling point of the water, which is 100 degrees Celsius, is an example of the constraints arising from a physical property of the heat-transfer medium. If the water circuit is short in length, the amount of heat storage is insufficient. As the defrosting operation is performed while the amount of heat storage is insufficient, the heating capability runs short part way through the defrosting operation. This is conceived to cause rapid reduction of the discharge temperature of the indoor unit, providing discomfort to a user.

Figure 3:
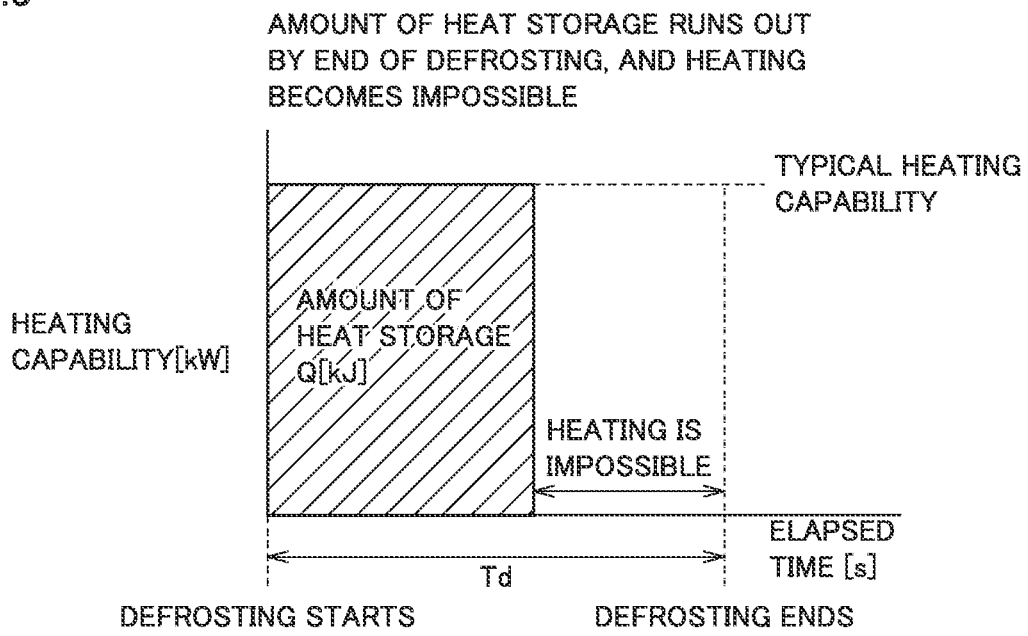
FIG. 3 is a schematic diagram illustrating the heating no longer maintained by the end of defrosting.
Figure 4:
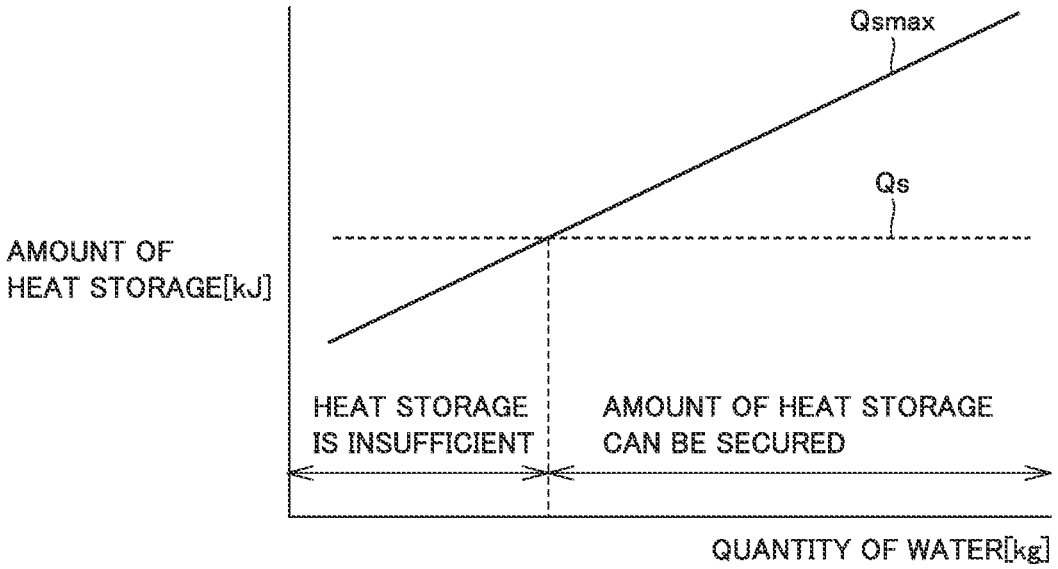
FIG. 4 is a schematic diagram illustrating an amount of a heat-transfer medium versus a maximum amount of heat storage.
Figure 5:
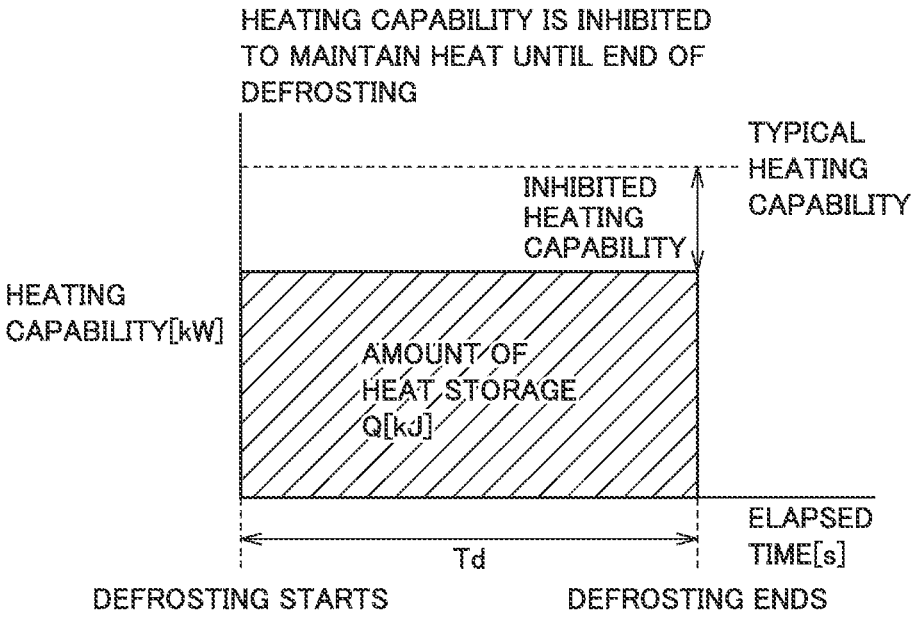
FIG. 5 is a schematic diagram illustrating that the heating is maintained during a defrosting operation in the air conditioning device according to the present embodiment.

FIG. 3 is a schematic diagram illustrating the heating no longer maintained by the end of defrosting. FIG. 4 is a schematic diagram illustrating the amount of heat-transfer medium versus the maximum amount of heat storage. FIG. 5 is a schematic diagram illustrating that the heating is maintained during the defrosting operation in the air conditioning device according to the present embodiment. Note that in FIGS. 3 and 5, the heating capability of the indoor unit is indicated on the vertical axis, and an elapsed time since the start of the defrosting operation is indicated on the horizontal axis. In FIG. 4, the amount of encapsulated heat-transfer medium (the quantity of water: Kg) circulating through secondary heat-transfer medium circuit 200 is indicated on the horizontal axis, and the amount (KJ) of heat storage accumulated in the heat-transfer medium within heat-transfer medium circuit 200 is indicated on the vertical axis.

In FIG. 3, amount Q (KJ) of heat storage of the heat-transfer medium is consumed up for the heating before the elapse of a defrost time Td, indicating that the heating is no longer maintained part way through the defrosting operation. As shown in FIG. 4, when the length of the pipe of heat-transfer medium circuit 200 is short and the quantity of water is small, a maximum amount Qsmax of heat storage is below the amount Qs of heat required for the heating during the defrosting operation, and such shortage in heat storage results. Thus, in the present embodiment, when the amount of heat storage is insufficient, the heating capability during the defrosting is previously inhibited at the start of the defrosting to be less than the capability during the heating operation in normal operation, and the heating operation is maintained with the inhibited capability until the end of defrosting operation, as shown in FIG. 5. This prevents a sharp decrease in discharge temperature of the indoor unit due to an insufficient amount of heat storage, causing no discomfort to the user.

In order to adjust the heating capability as such, the air conditioning device is configured as follows. In other words, air conditioning device 1000 includes refrigerant circuit 100, heat-transfer medium circuit 200, and control device 31. Refrigerant circuit 100 includes compressor 1, switching valve 2, cascade heat exchanger 3, expansion valve 4, and outdoor heat exchanger 5, which are connected to one another by first pipe 21 through which the refrigerant flows, and refrigerant circuit 100 performs a defrosting operation in which the refrigerant discharged from compressor 1 is introduced into outdoor heat exchanger 5. Heat-transfer medium circuit 200 includes pump 12, cascade heat exchanger 3, and indoor heat exchanger 11, which are connected to one another by second pipe 23 through which the heat-transfer medium flows, Cascade heat exchanger 3 corresponds to a "first heat exchanger," outdoor heat exchanger 5 corresponds to a "second heat exchanger," and indoor heat exchanger 11 corresponds to a "third heat exchanger." Control device 31 controls compressor 1 and pump 12.

Control device 31 performs the defrosting operation while maintaining the heating, with the heating capability of indoor heat exchanger 11 during the defrosting operation set to a capability that is determined based on an amount of heat storage of the heat-transfer medium within heat-transfer medium circuit 200. If the amount of heat storage of the heat-transfer medium is less than maximum amount Qsmax of heat storage, which is a threshold, control device 31 reduces the heating capability of indoor heat exchanger 11 when air conditioning device 1000 transitions from the heating operation to the defrosting operation.

Preferably, heat-transfer medium circuit 200 includes flow regulating valve 14 which regulates the flow rate of the heat-transfer medium flowing through indoor heat exchanger 11. In response to the start of the defrosting operation, control device 31 changes a degree of opening of flow regulating valve 14 so that the heating capability of indoor heat exchanger 11 is equal to the capability that is determined based on the amount of heat storage of the heat-transfer medium within heat-transfer medium circuit 200. Note that as the temperature of the heat-transfer medium decreases during the defrosting operation, control device 31 may adjust the degree of opening of flow regulating valve 14, accordingly, so that the heating capability of indoor heat exchanger 11 is kept constant.

The amount of heat-transfer medium within heat-transfer medium circuit 200 depends on the length of pipe 23. Since the length of the pipe of heat-transfer medium circuit 200 is different at a different construction place, it is necessary that the control device 31 previously ascertains the amount of heat-transfer medium that circulates through heat-transfer medium circuit 200. While an operator or the user may register the amount of heat-transfer medium or the length of the pipe with control device 31 at the completion of the construction, a method will be described now in which control device 31 automatically detects the amount of heat-transfer medium.

Figure 6:
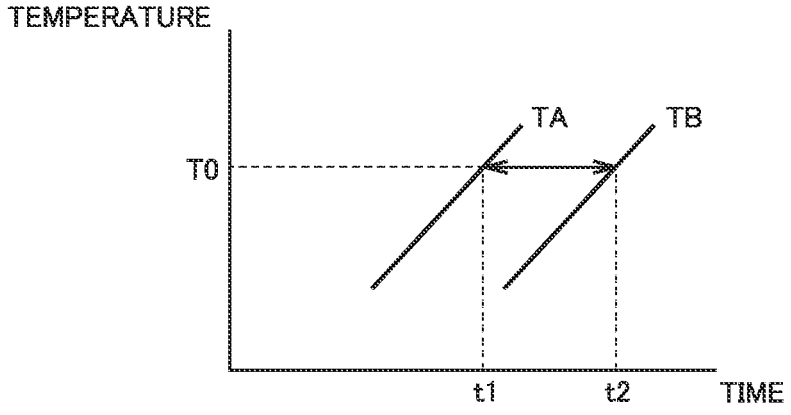
FIG. 6 is a diagram schematically representing changes over time in temperature TA of a heat-transfer medium at a secondary outlet of a cascade heat exchanger 3 and changes over time in temperature TB of a heat-transfer medium at an inlet of an indoor heat exchanger 11, at the beginning of a heating operation.

FIG. 6 is a diagram schematically representing changes over time in temperature TA of the heat-transfer medium at the secondary outlet of cascade heat exchanger 3 and changes over time in temperature TB of the heat-transfer medium at the inlet of indoor heat exchanger 11, at the beginning of the heating operation.

At the beginning of the heating operation, temperature TA and temperature TB increase aver time. Suppose that temperature TA reaches a temperature T0 at t1, and temperature TB reaches temperature T0 at t2. Difference Δt between t2 and t1 reflects amount MW of heat-transfer medium present between the secondary outlet of cascade heat exchanger 3 and indoor heat exchanger 11. In other words, amount MW of heat-transfer medium present between the secondary outlet of cascade heat exchanger 3 and indoor heat exchanger 11 can be determined by multiplying Δt by the heat-transfer medium flow rate in pump 12. Amount MW of heat-transfer medium present between the secondary outlet of cascade heat exchanger 3 and indoor heat exchanger 11 is determined because the outbound path and the return path of a water circuit are typically the same, and knowing the amount of heat-transfer medium on the outbound path, the amount of heat-transfer medium on the return path can be considered to be about the same.

During a test operation of air conditioning device 1000, control device 31 increases the frequency of compressor 1 greater than in the heating operation, and keeps the flow rate of pump 12 constant. Control device 31 multiplies a flow rate Gw of pump 12 by a difference between time t1 at which temperature TA of the heat-transfer medium at the secondary outlet of cascade heat exchanger 3 reaches a predetermined temperature T0 and time t2 at which the temperature of the heat-transfer medium at the inlet of indoor heat exchanger 11 reaches a predetermined temperature T0, thereby calculating an amount of heat-transfer medium present between the secondary outlet of cascade heat exchanger 3 and the inlet of indoor heat exchanger 11.

Figure 7:
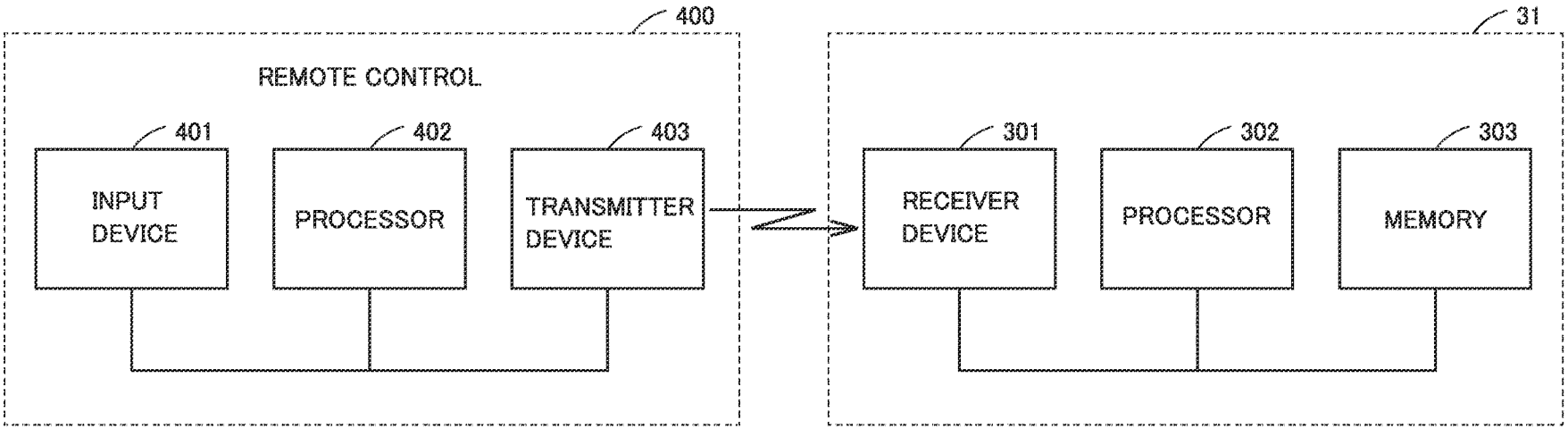
FIG. 7 is a diagram showing a configuration of a control device for controlling the air conditioning device, and a configuration of a remote control for remotely controlling the control device.

FIG. 7 is a diagram showing a configuration of a control device for controlling the air conditioning device and a configuration of a remote control for remotely controlling the control device. Referring to FIG. 7, a remote control 400 includes an input device 401, a processor 402, and a transmitter device 403. Input device 401 includes a button for allowing the user to switch the indoor unit between ON/OFF, a button for entering a set temperature, etc. Transmitter device 403 communicates with control device 31. Processor 402 controls transmitter device 403, in accordance with an input signal given from input device 401.

Control device 31 includes a receiver device 301, a processor 302, and a memory 303.

Memory 303 includes, for example, a ROM (Read Only Memory), a RAM (Random Access Memory), and a flash memory. Note that the flash memory stores the operating system, application programs, and various data, etc.

Processor 302 controls the overall operation of air conditioning device 1000. Note that control device 31 shown in FIG. 1 is implemented by processor 302 executing the operating system and the application programs stored in memory 303. Note that various data stored in memory 303 are referred to for the executions of the application programs.

With the above configuration, a memory 303 stores information on the amount of heat-transfer medium within heat-transfer medium circuit 200. A processor 302 determines the degree of opening of flow regulating valve 14 during the defrosting operation, based on the information stored in the memory.

Receiver device 301 communicates with a remote control 400. If the indoor unit is configured of multiple indoor units, receiver device 301 may be provided for each indoor unit.

Note that control device 31 may be configured of multiple control units. In this case, each control unit includes a processor. In such a case, the processors perform overall control on air conditioning device 1000 in cooperation with each other.

In the following, a control will be described in which control device 31 performs the test operation to automatically detect amount MW of heat-transfer medium.

Figure 8:
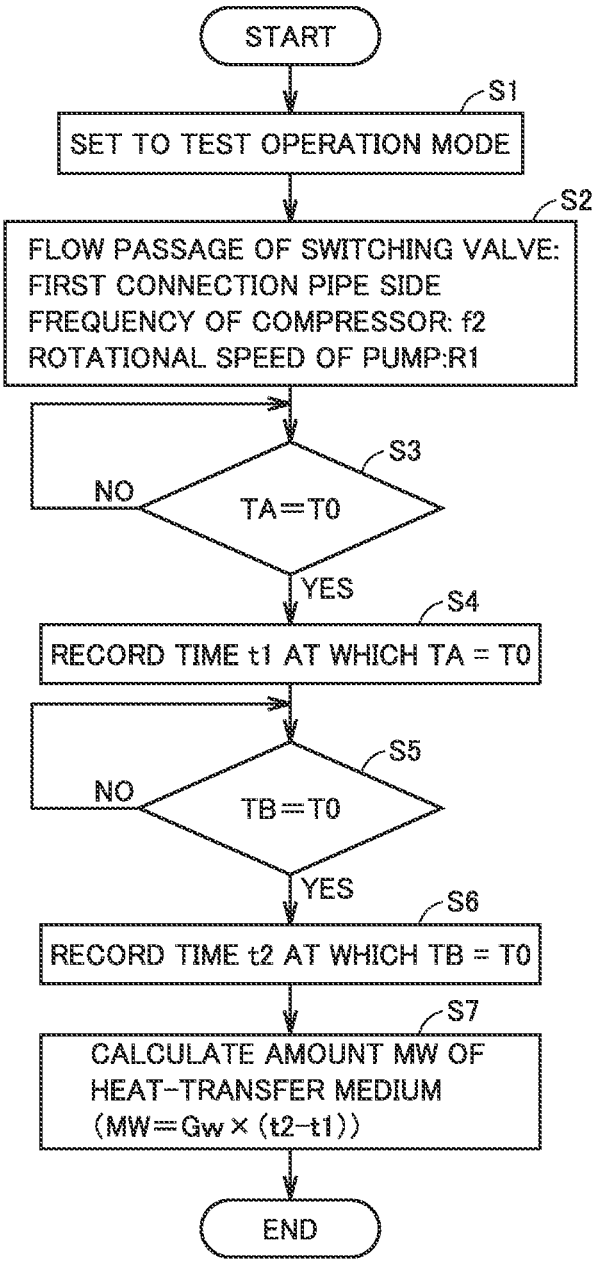
FIG. 8 is a flowchart representing a procedure for identifying an amount MW of heat-transfer medium present between the outlet of cascade heat exchanger 3 and indoor heat exchanger 11.

FIG. 8 is a flowchart representing a procedure for identifying amount MW of heat-transfer medium present between the outlet of cascade heat exchanger 3 and indoor heat exchanger 11. As shown in FIG. 8, control device 31 previously calculates the amount of heat-transfer medium within heat-transfer medium circuit 200, based on changes in temperature of the heat-transfer medium. The amount of heat-transfer medium may be calculated prior to the defrosting operation. Preferably, the calculation is performed, for example, during the test operation e the completion of installation of the air conditioning device.

In step S1, control device 31 sets air conditioning device 1000 to a test operation mode. Next, in step S2, control device 31 sets the flow passage of switching valve 2 so that the discharge port of compressor 1 and the primary inlet of cascade heat exchanger 3 for the refrigerant are in communication. Control device 31 sets the frequency of compressor 1 to f2. Control device 31 sets the rotational speed of pump 12 to R1.

In step S3, control device 31 waits for temperature TA of the heat-transfer medium at the secondary outlet of cascade heat exchanger 3, detected by temperature sensor 33, to reach temperature T0. If temperature TA of the heat-transfer medium at the secondary outlet of cascade heat exchanger 3, detected by temperature sensor 33, reaches predetermined temperature T0 (YES in S3), control device 31 proceeds the process to step S4.

In step S4, control device 31 records time t1 at which temperature TA has reached temperature T0.

in step S5, if temperature TB of the heat-transfer medium at the inlet of indoor heat exchanger 11, detected by temperature sensor 32, reaches predetermined temperature T0, the process proceeds to step S6.

In step S6, control device 31 records time t2 at which temperature TB has reached temperature T0.

In step S7, control device 31 calculates amount MW of heat-transfer medium, in accordance with Equation (1):

$$MW=Gw\times(t2-t1) \tag{1}$$

where Gw denotes a heat-transfer medium flow rate corresponding to rotational speed R1 of pump 12.

Figure 9:
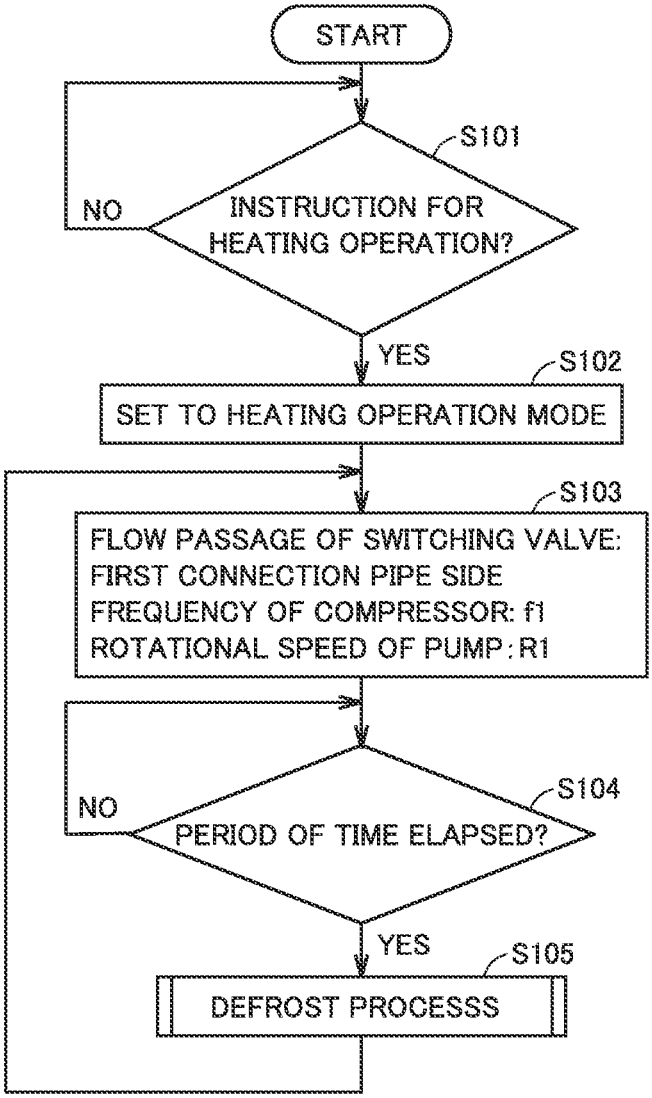
FIG. 9 is a flowchart for illustrating a control that is performed by the control device for the heating operation in the present embodiment.

FIG. 9 is a flowchart for illustrating a control that is performed by the control device for the heating operation in the present embodiment.

If an instruction for the heating operation is input in step S101, control device 31 proceeds the process to step S102.

In step S102, control device 31 sets air conditioning device 1000 to the heating operation mode.

In step S103, control device 31 sets the flow passage to switching valve 2 so that the discharge port of compressor 1 and the primary inlet of cascade heat exchanger 3 for the refrigerant are in communication. Control device 31 sets the frequency of compressor 1 to f1. Control device 31 sets the rotational speed of pump 12 to R1. Values of frequency f1 and rotational speed R1 are designed to yield optimal operating efficiency of the heating operation.

After the initiation of the heating operation, in step S104, control device 31 waits for a period of time to elapse. As a period of time elapses (YES in S104), control device 31 proceeds the process to step S105. In step S105, the defrost process is performed, after which the processes at and after S103 are performed again to repeat the heating and the defrosting.

Figure 10:
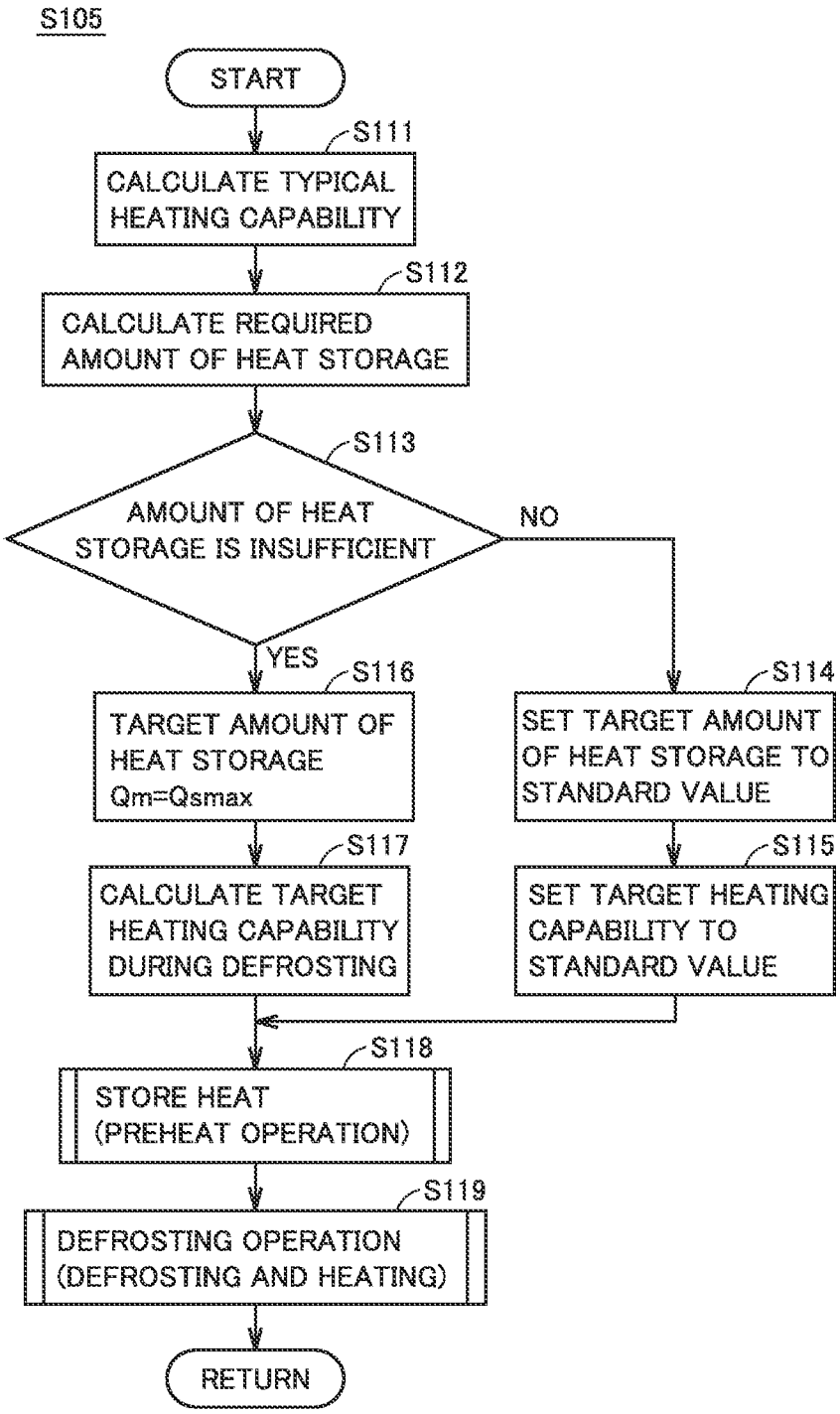
FIG. 10 is a flowchart for illustrating details of a defrost process performed in step S105.

FIG. 10 is a flowchart for illustrating details of the defrost process performed in step S105.

Initially, in step S111, control device 31 calculates a typical heating capability in the current heating settings. The typical heating capability is an amount of heat exchanged in indoor heat exchanger 11, and indicated by Equation (2):

$$qs=Gw\times Cp\times(TB-TC) \tag{2}$$

where qs represents the typical heating capability of indoor heat exchanger 11, Gw represents the heat-transfer medium flow rate in pump 12, Cp represents a specific heat at constant pressure of the heat-transfer medium, TB represents a temperature of the heat-transfer medium at the inlet of indoor heat exchanger 11, and TC represents a temperature of the heat-transfer medium at the outlet of indoor heat exchanger 11. The typical heating capability is also determined by a set temperature of the remote control or the like, and the room temperature.

Next, in step S112, control device 31 calculates amount Qs of heat that is required to maintain the typical heating capability during the defrost time Td. The amount Qs of heat is indicated by Equation (3):

$$Qs=qs\times Td \tag{3}$$

where Qs represents a required amount of heat, qs represents the typical heating capability, and Td represents the defrost time.

Next, in step S113, control device 31 determines whether the amount of heat storage is insufficient. Here, if Qs>Qsmax, the amount of heat storage is determined to be insufficient, where Qs denotes the required amount of heat determined by Equation (3), anad Qsmax denotes the maximum amount of heat storage shown in FIG. 4.

Using the quantity Mw of water previously calculated at the test operation illustrated in the flowchart of FIG. 8, maximum amount Qsmax of heat storage is calculated by Equation (4):

$$Qs\max=Mw\times Cp\times(TB\max-TB) \tag{4}$$

Note that, rather than the total quantity of water, the quantity of water on the outbound path may be indicated on the horizontal axis of FIG. 4, and a map may be provided from which maximum amount Qsmax of heat storage can be previously known, and maximum amount Qsmax of heat storage may be determined by referring to the map.

Here, Cp denotes the specific heat at constant pressure (fluid physical properties of the secondary cycle), TBmax denotes the maximum temperature at the inlet of the indoor unit, and TB denotes the temperature at the inlet of the indoor unit measured by temperature sensor 32.

If the amount of heat storage is determined to be insufficient (YES in S113), it is necessary that the target amount of heat storage and an inhibition value for the heating capability with the heat storage during the defrosting, are calculated. Accordingly, in step S116, control device 31 sets target amount Qm of heat storage to maximum amount Qsmax of heat storage.

Next, in step S117, control device 31 calculates a target heating capability qsm that is inhibited during the defrosting, by Equation (5):

$$qsm=Qs\max/Td \tag{5}$$

If the amount of heat storage is determined not to be insufficient (NO in S113), the target amount of heat storage and the heating capability with the heat storage accumulated during the defrosting are set so as to maintain the current heating capability. Accordingly, in step S114, control device 31 sets target amount Qm of heat storage to a standard value. Control device 31 sets an amount of heat greater than or equal to amount Qx of heat required for defrost, as target amount Qm of heat storage accumulated in the heat-transfer medium during the preheat operation. Specifically, target amount Qm of heat storage is determined by target temperature TM of the heat-transfer medium. Accordingly, control device 31 calculates target temperature TM.

Control device 31 calculates target temperature TM by Equation (6):

$$TM=\{Qy/(MW\times Cp)\}+TB \quad (6)$$

where MW denotes the amount of heat-transfer medium present between the secondary outlet of cascade heat exchanger 3 and the inlet of indoor heat exchanger 11, Qy (=Qm) denotes the amount of heat accumulated in the heat-transfer medium during the preheat operation, TB denotes the temperature of the heat-transfer medium at the inlet of indoor heat exchanger 11 at the start of the preheating, and Cp denotes the specific heat at constant pressure of the heat-transfer medium.

Then, in step S115, control device 31 sets target heating capability qsm to a standard value. Target heating capability qsm is determined by, for example, a relational expression in which target heating capability qsm is proportional to a difference between the room temperature and the outdoor air temperature.

Then, control device 31 stores heat by performing the preheat operation in step S118, and performs the defrosting operation in step S119 and continues the heating with the heat storage.

As such, if the amount of heat storage is insufficient, the heating is initiated in the defrosting operation, with previously-inhibited heating capability. Thus, according to the air conditioner of the present embodiment, a sharp decrease in discharge temperature of the indoor unit due to insufficient heat storage is prevented, causing no discomfort to the user.

Figure 11:
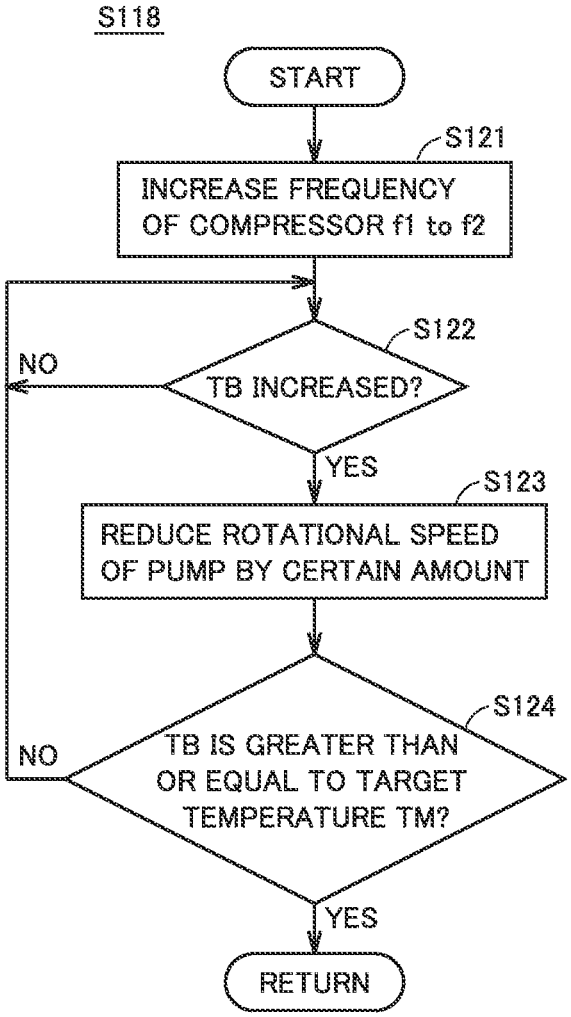
FIG. 11 is a flowchart for illustrating a heat storage process performed by a preheat operation of step S118 of FIG. 10.

FIG. 11 is a flowchart for illustrating a heat storage process performed by the preheat operation of step S118 of FIG. 10. As shown in FIG. 11, in the preheat operation, which is performed prior to the transition of air conditioning device 1000 from the heating operation to the defrosting operation, control device 31 increases the frequency of compressor 1 as compared to the heating operation, and reduces the rotational speed of pump 12.

During the execution of the processes illustrated in the flowchart, control device 31 sets air conditioning device 1000 to the preheat operation mode. Initially, in step S121, control device 31 increases the frequency of compressor 1 to 12, provided that 12 is a frequency higher than frequency f1 set in step S103 of FIG. 9. This causes an increase in water temperature on the secondhand side of cascade heat exchanger 3. As the water, whose the temperature is increased on the secondary side of cascade heat exchanger, is conveyed to the inlet of indoor heat exchanger 11, temperature TB increases.

In step S122, control device 31 waits for temperature TB of the heat-transfer medium at the inlet of indoor heat exchanger 11 detected by temperature sensor 32 to increase. As temperature TB increases (YES in S122), control device 31 performs the process of step S123.

In step S123, control device 31 reduces the rotational speed of pump 12 by a certain amount.

In step S124, it is determined whether temperature TB of the heat-transfer medium at the inlet of indoor heat exchanger 11 detected by temperature sensor 32 is greater than or equal to predetermined target temperature TM. If temperature TB of the heat-transfer medium at the inlet of indoor heat exchanger 11 is less than predetermined target temperature TM NO in S124), the process returns to step S122. If temperature TB is greater than or equal to target temperature TM (YES in S124), the process returns to the flowchart of FIG. 10, and the process of step S119 is performed subsequently.

The processes of steps S122 through S124 adjust the rotational speed of pump 12 so that the heating capability of the indoor unit is the same as before the water temperature is increased.

The reduction in rotational speed of pump 12 reduces the water flow rate, which increases temperature TA of the heat-transfer medium at the outlet of cascade heat exchanger 3, and increases also temperature TB along with the movement of the heat-transfer medium. Thereafter, the processes of step S122 through S124 are repeated until temperature TB reaches target temperature TM.

The preheat operation described above allows the temperature of the heat-transfer medium to be set to target temperature TM while keeping the heating capability constant.

Figure 12:
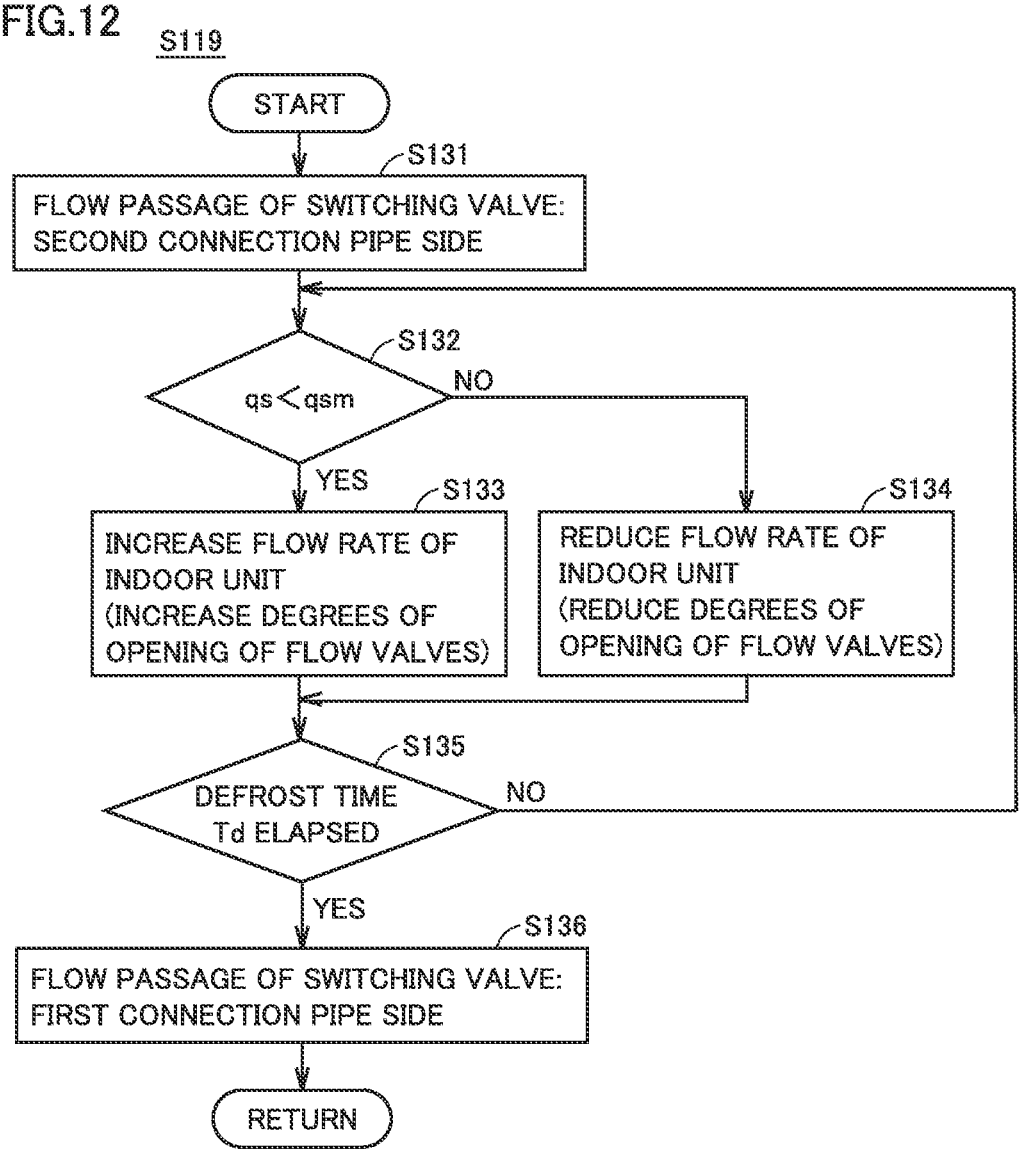
FIG. 12 is a flowchart for illustrating the heat during a defrosting operation performed in step S119 of FIG. 10.

FIG. 12 is a flowchart for illustrating the heat during the defrosting operation performed in step S119 of FIG. 10. During the execution of the processes of the flowchart, control device 31 sets air conditioning device 1000 to the defrosting operation mode.

In step S131, control device 31 sets the flow passage of switching valve 2 so that bypass pipe 22 and the discharge side of compressor 1 are in communication. Control device 31 initially keeps the frequency of compressor 1 and the rotational speed of pump 12 unchanged since the end of the preheat operation.

In step S132, control device 31 calculates the current heating capability qs by Equation (2), already described above, to determine whether heating capability qs is less than target heating capability qstn.

If qs<qsm (YES in S132), control device 31 increases degrees of opening of flow regulating valves 14*a*, 14*b* of the indoor unit to increase the heating capability. If qs≥qsm (NO in S132), in contrast, control device 31 reduces the degrees of opening of flow regulating valves 14*a*, 14*b* of the indoor unit to reduce the heating capability.

Next, in step S135, control device 31 returns the process to step S132 until defrost time Td elapses since the start of the defrosting to continue to adjust the heating capability.

If defrost time Td has elapsed since the start of the defrosting in step S135, control device 31 proceeds the process to step S136, sets the flow passage of switching valve 2 so that the discharge side of compressor 1 is in communication with the primary inlet of cascade heat exchanger 3, and ends the defrosting operation.

Figure 13:
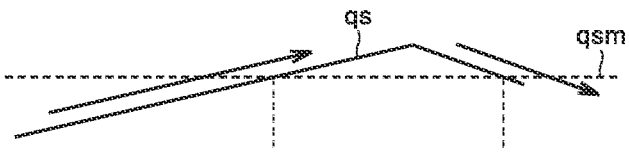
FIG. 13 is a diagram summarizing the regulation of a quantity of water by a flow regulating valve during the defrosting operation.

FIG. 13 is a diagram summarizing the regulation of the quantity of water by the flow regulating valve during the defrosting operation. During the defrosting operation, if the current heating capability qs exerted by the indoor heat exchanger is less than target heating capability qsm, control device 31 increases the degrees of opening of flow regulating valves 14*a*, 14*b* to increase the quantity of water circulating.

If qs>qsm as a result of the increase in quantity of water, in contrast, control device 31 reduces the degrees of opening of flow regulating valves 14*a*, 14*b* to reduce the quantity of water circulating.

By controlling the flow regulating valve as such, the heating is performed with the inhibited heating capability, as illustrated in FIG. 5, during the defrosting operation.

While the present embodiment has been described with reference to adjusting the heating capability during the defrosting operation by the flow regulating valve, it should be noted that the heating capability may be adjusted by other methods. For example, the quantity of water delivered by pump 12 may be changed, or the volumes of air blown by blowers 13*a*, 13*b* may be changed.

The presently disclosed embodiment should be considered as illustrative in all aspects and do not limit the present disclosure. The scope of the present disclosure is defined by the appended claims, rather than by the above description of the embodiment. All changes which come within the meaning and range of equivalency of the appended claims are intended to be embraced within their scope.

REFERENCE SIGNS LIST

1 compressor; 2 switching valve; 3 cascade heat exchanger; 4 expansion valve; 5 outdoor heat exchanger; 6, 13, 13*a*, 13*b* blower; 11, 11*a*, 11*b* indoor heat exchanger; 12 pump; 14, 14*a*, 14*b* flow regulating valve; 21 first pipe; 22 bypass pipe; 23 second pipe; 31 control device; 32, 33, 34 temperature sensor; 100 refrigerant circuit; 102, 302, 402 processor; 103, 303 memory; 200 heat-transfer medium circuit; 301 receiver device; 400 remote control; 401 input device; 403 transmitter device; 1000 air conditioning device.

The invention claimed is:

1. An air conditioning device, comprising:

a refrigerant circuit that is formed of a compressor, a first heat exchanger, an expansion valve, and a second heat exchanger connected to one another by a first pipe through which a refrigerant flows, the refrigerant circuit being configured to perform a defrosting operation in which the refrigerant discharged from the compressor is introduced into the second heat exchanger;

a heat-transfer medium circuit that is formed of a pump, the first heat exchanger, and a third heat exchanger connected to one another by a second pipe through which a heat-transfer medium flows; and a control device configured to control the compressor and the pump, perform the defrosting operation and at a same time keep heating, with a heating capability of the third heat exchanger during the defrosting operation set to a capability that is determined based on an amount of heat storage of the heat-transfer medium within the heat-transfer medium circuit, and responsive to the air conditioning device transitioning from a heating operation to the defrosting operation and the amount of heat storage of the heat-transfer medium being less than a threshold maximum heat storage amount, reduce the heating capability of the third heat exchanger while the air conditioning device transitions from the heating operation to the defrosting operation.

2. The air conditioning device according to claim 1, wherein the heat-transfer medium circuit includes a flow regulating valve for regulating a flow rate of the heat-transfer medium flowing through the third heat exchanger, and the control device is configured to, in response to initiation of the defrosting operation, change a degree of opening of the flow regulating valve so that the heating capability of the third heat exchanger is equal to the capability that is determined based on the amount of heat storage of the heat-transfer medium within the heat-transfer medium circuit.

3. The air conditioning device according to claim 2, wherein the control device includes a memory storing information on an amount of heat-transfer medium within the heat-transfer medium circuit, and a processor that determines, based on the information, the degree of opening of the flow regulating valve during the defrosting operation.

4. The air conditioning device according to claim 1, wherein the control device is configured to calculate an amount of heat-transfer medium within the heat-transfer medium circuit, based on a change in temperature of the heat-transfer medium.

5. The air conditioning device according to claim 1, wherein the control device is configured to, in a preheat operation, which is performed before the air conditioning device transitions from the heating operation to the defrosting operation, increase a frequency of the compressor and reduce a rotational speed of the pump, as compared to during the heating operation.

6. The air conditioning device according to claim 2, wherein the control device is configured to, in a preheat operation, which is performed before the air conditioning device transitions from the heating operation to the defrosting operation, increase a frequency of the compressor and reduce a rotational speed of the pump, as compared to during the heating operation.

7. The air conditioning device according to claim 3, wherein the control device is configured to, in a preheat operation, which is performed before the air conditioning device transitions from the heating operation to the defrosting operation, increase a frequency of the compressor and reduce a rotational speed of the pump, as compared to during the heating operation.

8. The air conditioning device according to claim 4, wherein the control device is configured to, in a preheat operation, which is performed before the air conditioning device transitions from the heating operation to the defrosting operation, increase a frequency of the compressor and reduce a rotational speed of the pump, as compared to during the heating operation.

* * * * *